United States Patent [19]

Lemmons

[11] Patent Number: 4,493,348

[45] Date of Patent: Jan. 15, 1985

[54] METHOD AND APPARATUS FOR ORALLY DISPENSING LIQUID MEDICATION

[75] Inventor: Joseph J. Lemmons, Colorado Springs, Colo.

[73] Assignee: PUR/ACC Corporation, Colorado Springs, Colo.

[21] Appl. No.: 455,877

[22] Filed: Jan. 5, 1983

Related U.S. Application Data

[63] Continuation-in-part of Ser. No. 278,170, Jun. 29, 1981, abandoned.

[51] Int. Cl.[3] ..... B65B 1/04

[52] U.S. Cl. ..... 141/1; 141/98; 141/27; 215/11 C; 222/542; 285/237; 285/DIG. 2; 604/54; 604/77; 604/91

[58] Field of Search ..... 285/237, DIG. 2; 141/1-12, 18-27, 285-310, 382-386, 311 R, 98; 215/11 C, 41, 73, 99; 222/542, 543, 548; 604/82, 91, 89, 56, 407, 416, 236, 238, 242, 54, 77, 78

[56] References Cited

U.S. PATENT DOCUMENTS

| | | | |
|---|---|---|---|
| 3,578,037 | 5/1971 | Flynn | 142/2 |
| 3,599,681 | 8/1971 | Hall | 141/383 |
| 3,633,586 | 1/1972 | Sheridan | 128/349 |
| 3,741,217 | 6/1973 | Clarton | 128/349 |
| 3,797,865 | 3/1974 | Ballentine | 285/DIG. 2 |
| 3,853,157 | 12/1974 | Madaio | 141/2 |
| 3,976,311 | 8/1976 | Spendlove | 285/DIG. 2 |
| 4,046,145 | 9/1977 | Choksi et al. | 128/215 |
| 4,128,098 | 12/1978 | Bloom et al. | 128/272.3 |
| 4,175,597 | 11/1979 | Peterson | 141/27 |
| 4,311,174 | 1/1982 | Walsh | 141/383 |

*Primary Examiner*—Houston S. Bell, Jr.

*Attorney, Agent, or Firm*—Sheridan, Ross & McIntosh

[57] ABSTRACT

A container housing liquid medication is provided together with a syringe and a coupling member for use in orally administering the medication to a patient. The coupling member is fastened to the container and includes a head member projecting upwardly to receive an inner tip of the syringe barrel. The liquid medication is dispensed from the container into a barrel of the syringe through a bore of the head member when a plunger is moved within the syringe barrel. After a predetermined amount of medication is received by the syringe barrel, the syringe barrel is removed from the head member and the predetermined amount of medication is administered orally to the patient. A cap member attached to the coupling member by means of a strap closes off the bore so that no medication escapes from the container when the syringe is disconnected from the head member. In one particular embodiment, a valve means is connected to the coupling member to permit selective communication between the container and the syringe barrel.

5 Claims, 11 Drawing Figures

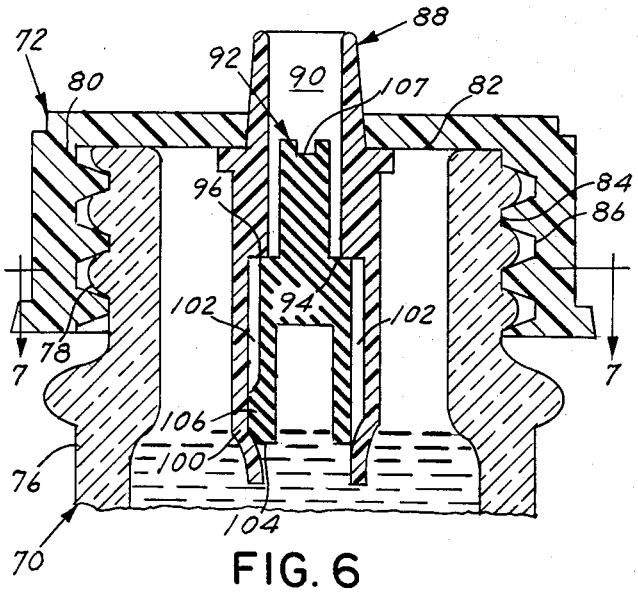
FIG. 6
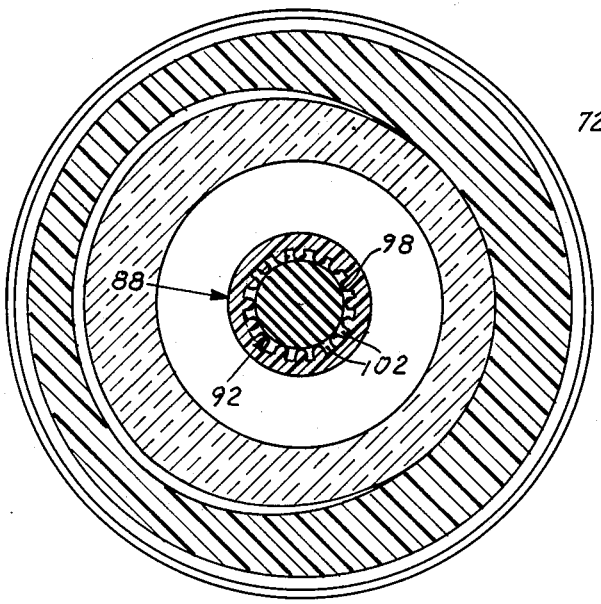
FIG. 7
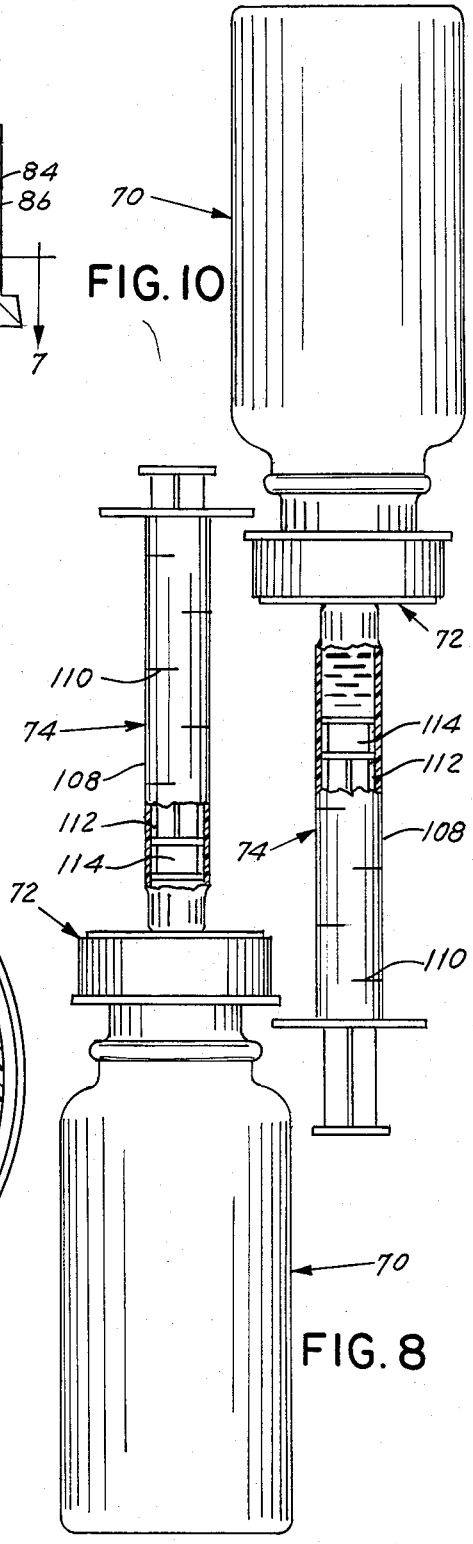
FIG. 10
FIG. 8

METHOD AND APPARATUS FOR ORALLY DISPENSING LIQUID MEDICATION

This is a continuation-in-part of application Ser. No. 278,170, filed June 29, 1981, now abandoned.

FIELD OF THE INVENTION

The present invention relates to an apparatus for providing a predetermined amount of liquid medication for use in orally dispensing the medication to a patient.

BACKGROUND ART

It is common practice to transfer medication from a bulk container to a syringe barrel. After the syringe barrel is filled with the medication, a needle is connected to the syringe barrel. The needle is used to pierce the skin of a patient and inject the medication, intravenously for example, into the patient. In administering medication in such a manner, it is highly important that contamination of the medication be minimized. As a consequence, elaborate and complex coupling mechanisms are required in order to transfer the medication from the bulk container to the syringe barrel.

The present invention is directed solely to the transfer of liquid medication from a bulk container to a syringe barrel so that a predetermined amount of medication can be administered to a patient through his mouth. Since the medication is given orally, the concern of contamination of the medication is significantly reduced. The coupling device of the present invention does not require extensive safeguards to minimize contamination thereof. Rather, the coupling device comprises few elements and is exposed to its surrounding environment for easy access and manipulation by the user.

In one device for loading a syringe barrel with medication for dispensing orally to a patient, a frusto-conical plug is used. The cap of a bulk container is removed and replaced by inserting the frusto-conical plug into the container. The plug is frusto-conical so that it can be inserted into various sized bulk container neck openings. The plug includes a bore which is adapated to be mated with the tip of the syringe barrel. However, it is difficult to provide a proper seal in the container with the plug. Oftentimes, the liquid escapes between the outer wall of the plug and the neck of the bulk container.

PRIOR ART STATEMENT

U.S. Pat. No. 3,853,157 to Madaio describes an apparatus for dispensing a liquid and which includes a container, a container top plug having a valve, and a syringe barrel. The container houses the liquid under pressure and the syringe barrel is attached to the plug. When the valve is opened, the pressure forces the liquid upward out of the container and into the syringe barrel. A needle is then attached to the syringe barrel in order to inject the liquid contents of the syringe barrel into a patient.

U.S. Pat. No. 4,046,145 to Choksi et al. provides a syringe connector which couples a larger liquid-containing syringe to to a smaller liquid-containing syringe. The connector includes a protective housing spaced outwardly from a tubular coupler to prevent contamination when the smaller syringe is filled with liquid.

U.S. Pat. No. 3,578,037 to Flynn describes a method and an apparatus for filtering foreign material, such as coring, while filling a syringe barrel with liquid from a large container. A needle is connected to the barrel of the syringe and inserted through a stopper held in the container and any air or coring in the syringe barrel is released into the liquid housed in the container. The needle is then positioned in a filtered area of the container for drawing liquid into the syringe barrel.

U.S. Pat. No. 3,128,098 to Bloom et al. discloses a vial transfer device having a spike which is inserted into a vial rubber stopper. A number of syringes can be filled with the liquid housed in the vial with only a single puncture of the rubber stopper.

DISCLOSURE OF THE INVENTION

In accordance with the present invention, a hypodermic syringe barrel is quickly and efficiently loaded from a container housing liquid medication using a coupling member which is attached to the container and which receives a tip of the syringe barrel. After loading, the syringe barrel can then dispense the liquid medication into the mouth of a patient.

More particularly, the present invention includes a container which holds liquid medication. The container has a neck to which the coupling member is fixedly fastened. The coupling member includes a head member projecting vertically from the outer surface of the coupling member. The head member has a bore formed therethrough. The top portion of the head member is interconnected to the outer tip of the syringe barrel. The syringe barrel includes a plunger which is initially positioned so that a plunger head is adjacent to the end of the syringe barrel to which the outer tip is joined. In order to dispense the liquid medication, a cap member is first removed from the bore of the head member so that the syringe barrel can be attached to the head member. The plunger is then moved rearwardly from the barrel permitting the escape of liquid from the container into the syringe barrel through the head member. The plunger is continuously moved until a predetermined amount of medication is contained in the syringe barrel. The liquid contained in the syringe barrel can then be dispensed orally to a patient.

In yet another embodiment of the present invention a coupling assembly, which includes a valve member, is fixedly fastened to the neck of a container which holds liquid medication. The coupling assembly includes a coupler body and a vertical head member which projects upward and downward from the top wall of the coupler body. The head member has a longitudinal bore formed through it. The bore of that portion of the head member which projects downward from the top wall of the coupler body houses the valve member. The bore of the portion of the head member which projects upward from the top wall of the coupler body is formed to connectably receive the inner tip of the syringe barrel. When the syringe barrel is connected to the head member of the coupling assembly, the inner tip of the syringe barrel extends far enough into the bore of the head member to contact and compress the valve member, and thereby open a valve. At all other times, the valve is closed so that nothing can pass out of or into the container. In order to dispense the liquid medication, the syringe barrel is connected to the coupling assembly as described above, thereby opening the valve. Initially, the plunger within the syringe barrel is positioned so that the plunger head is adjacent to the end of the syringe barrel from which the inner and outer tip extend. After connecting the syringe barrel to the coupling assembly, the container/coupling assembly/syringe combination is inverted so that as the plunger is moved rearwardly through the barrel of the syringe, the resultant vacuum within the barrel will draw the liquid inside of the container through the head member and valve, and into the syringe barrel. The plunger is continuously moved until the desired amount of medication is drawn into the syringe barrel. The liquid contained in the syringe barrel can then be dispensed orally to a patient.

In view of the above description, it is readily discerned that the present invention provides a relatively simple yet efficient manner of dispensing a predetermined amount of liquid medication to a patient. The present invention minimizes the considerable difficulty present in attempting to load a liquid from a relatively large openneck container through a narrow tipped syringe barrel. The coupling member of the present invention is readily adapted to be fastened to a bulk liquid container. The head member is adapted to sealingly receive a syringe barrel tip. After the syringe barrel has been filled to the desired point, the syringe is quickly and easily removed from the head member so that the liquid medication can be orally dispensed to the patient. When the syringe is disconnected from the coupling member, the head member is sealed to prevent contamination of the medication housed in the container.

Additional advantages of the present invention will become readily apparent from the following discussion taken in conjunction with the accompanying drawings.

BRIEF DESCRIPTION OF THE DRAWINGS

FIG. 6 is a longitudinal section of yet another embodiment of the present invention and shows a coupling assembly including valve means fixedly fastened to a container;

FIG. 7 is a lateral section, taken along line 7—7 of FIG. 6, showing further details of the coupling assembly;

FIG. 8 is a side elevational view of the embodiment of FIG. 6 showing the syringe barrel connected to the head member of the coupling assembly before dispensation of the liquid medication;

FIG. 10 is a side elevational view of the embodiment of FIG. 6 with portions of the syringe barrel cutaway to show the syringe barrel receiving liquid from the container.

DESCRIPTION OF THE PREFERRED EMBODIMENTS

Figure 1:
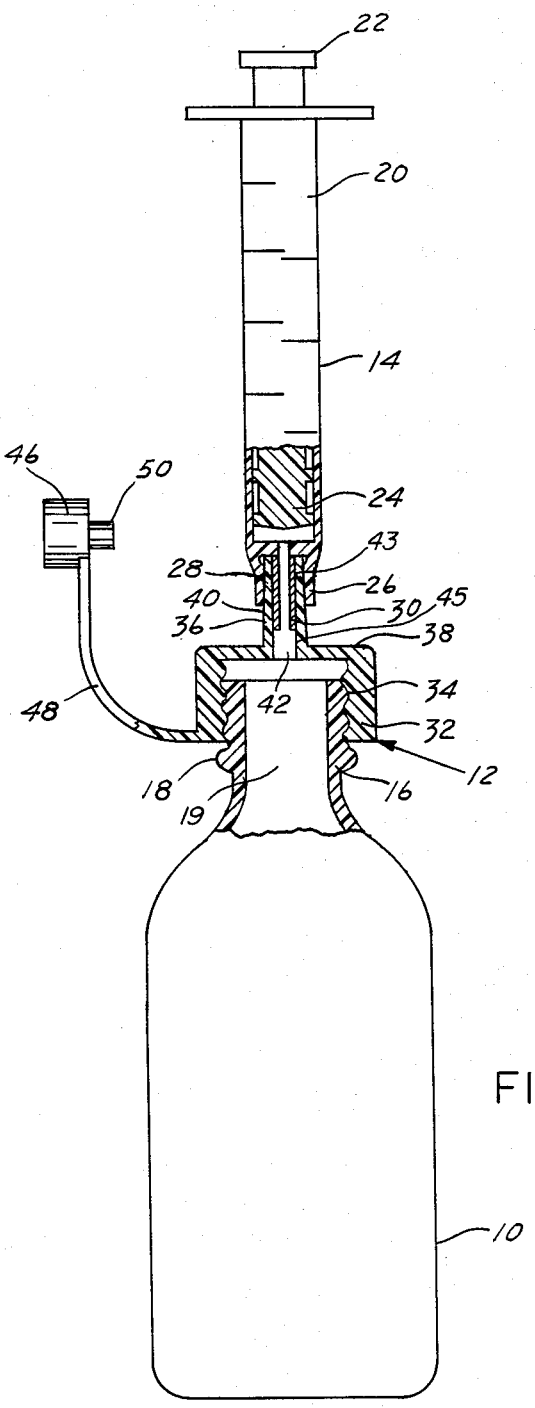
FIG. 1 is a side elevational view of the present invention with portions of the container, coupling member, and syringe cut-away.

In accordance with the present invention, a medication dispensing system is provided and which includes a container 10, a coupling member or coupling device 12 and a syringe 14, as depicted in FIG. 1. The container 10 houses liquid medication intended for dispensing orally to a patient. The container includes a cylindrical neck 16 having a threaded outer wall 18. An opening 19 is formed in the neck 16.

The syringe 14 is adapted to receive the oral medication from the container 10. The syringe 14 is provided for assuring that a predetermined amount of the medication housed in the container 10 is administered to the patient. The syringe 14 includes marking lines formed on a barrel 20 for indicating the amount of liquid transferred from the container 10 to the syringe 14. The syringe 14 further includes a plunger 22 for sliding movement within the barrel 20. A rubber stopper or plunger head 24 is connected to an end of the plunger 22. A hollow outer tip or flange 26 having an inner wall 28 is connected to an end of the syringe barrel 20 and concentrically surrounds a portion of an inner tip 30 which extends outwardly beyond the outer tip 28, as can be seen in FIG. 1.

The coupling member 12 is adapted to interconnect the container 10 and the syringe 14 so that the liquid medication can be readily transferred from the bulk container 10 through the opening 19 to the syringe barrel 20. The coupling member 14 includes a hollow coupler body or skirt 32 having an inner side wall 34. The inner side wall 34 includes screw threads for fastening the coupling member 12 to the outer wall 18 of neck 16. It is readily understood that the coupling member 12 can be joined to the outer wall 18 by means other than screw threads, such as by snapping the coupler member 12 to the outer wall 18.

The coupling member 12 also includes a head member 36 which is integrally joined to the outer surface 38 of the coupling body 32. The head member 36 extends outwardly vertically from the coupling body 32 and in a direction away from the container 10. The head member 36 is substantially parallel to the longitudinal extent of the container 10 and the syringe 14. Portions of the periphery 40 of the head member 36 are exposed to the surrounding environment for connection to the syringe 14.

Figure 2:
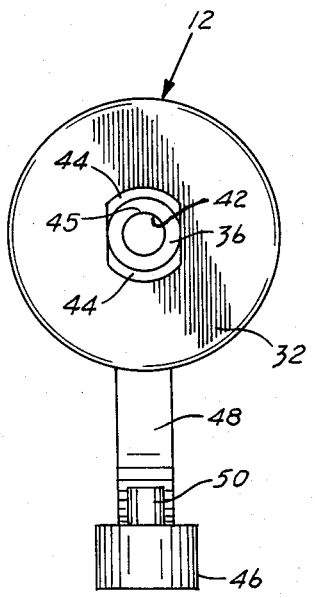
FIG. 2 is a top plan view of the coupling member of the present invention.

The head member 36 has a bore 42, as indicated in FIGS. 1 and 2. The bore 42 is generally circular in cross section and is of a sufficient diameter to receive thereinto the inner tip 30 of the syringe barrel 20 to provide fluid communication between the container 10 and the syringe 14. The tip 30 has an outer peripheral surface 43 which engages an inner bore surface 45 of the bore 42. The head member 36 is also of a sufficient diameter so that the outer tip 26 surrounds a portion thereof in order to attach the syringe 14 to the coupling member 12.

As also seen in FIG. 2, a pair of ribs 44 are integrally joined to a top portion of the head member 36. The ribs 44 surround a portion of the periphery 40 of the head member 36 and extend for a relatively short distance contiguous with the periphery 40 of the head member 36. The ribs 44 assist in assuring that the syringe 14 is securably fastened to the coupling member 12 when the liquid from container 10 is transferred to the barrel 20.

The coupling member 12 further includes a generally cylindrical cap member 46. The cap member 46 is integrally joined to a bottom portion of the coupling body 32 by a strap 48. The strap 48 enables the cap member 46 to remain fixedly attached to the coupling body 36 while the syringe 14 is connected to the coupling member 12. The strap 48 is flexible to permit movement of the cap member 46 towards and away from the head member 36. A cylindrical plug 50 is connected to a first end of the cap member 46 and extends vertically beyond a second end of the cap member 46. The plug 50 is just smaller in diameter than the bore 42 of head member 36 so that, when the syringe 14 is not connected to the head member 36, the plug 50 is inserted into the bore 42 to prevent unwanted escape of the liquid medication from the container 10 while the cap member 46 surrounds a portion of the periphery 40 of the head member 36.

Figure 3:
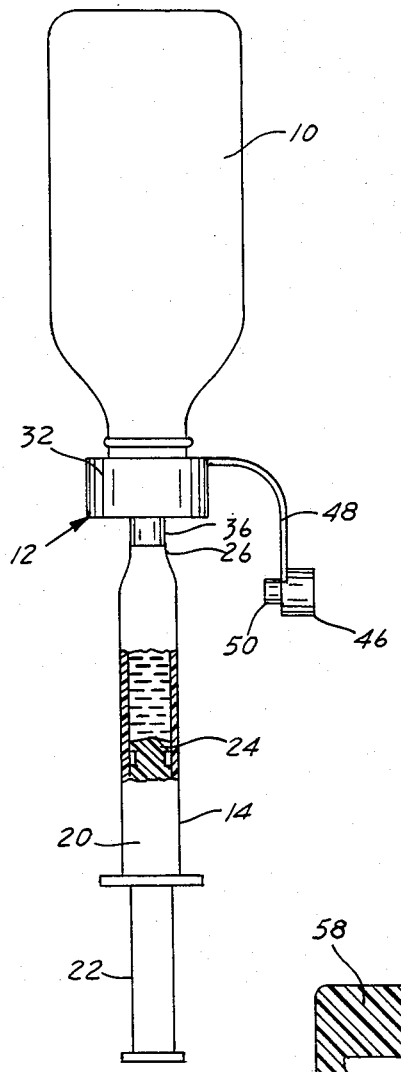
FIG. 3 is a side elevational view of the present invention showing the syringe receiving liquid from the container.
Figure 4:
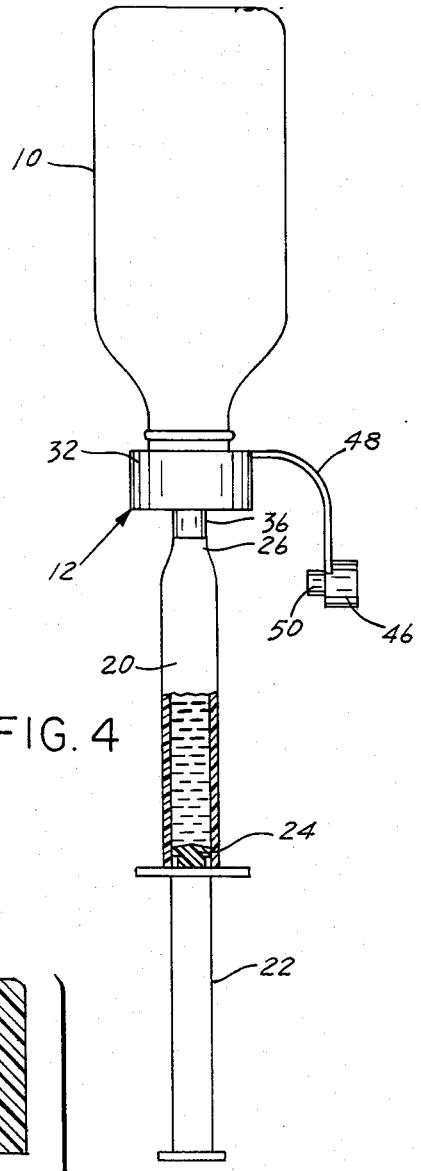
FIG. 4 is a side elevational view showing the syringe after receiving a predetermined amount of liquid.

In operation of the present invention, the cap member 46 and plug 50 are detached from the head member 36 of the coupling member 12 and the syringe 14 is connected to the coupling member 12 while the syringe 14 is located upwardly relative to the continer 10. The rubber stopper 24 is positioned adjacent the outer and inner tips 26, 30 of the syringe 14. As illustrated in FIG. 3, the container 10 is inverted such that the syringe 14 is downward relative to the container 10. The plunger 22 is moved vertically in a downward direction. This movement of the plunger 22 creates a vacuum so that liquid in the container 10 flows from the neck 18 of the container 10 into the inner tip 30 and then into the syringe barrel 20. The rubber stopper 24 is moved to a predetermined position in the barrel 20 so that a predetermined amount of liquid is received by the barrel 20, as illustrated in FIG. 4. After the desired amount of liquid is transferred into the barrel 20, the syringe 14 is removed from the head member 36. The cap member 46 and plug 50 are reattached to the head member 36 to prevent escape of liquid from the container 10. The predetermined liquid contents of the syringe 14 are then administered to the patient by dispensing the liquid into the mouth of the patient.

Figure 5:
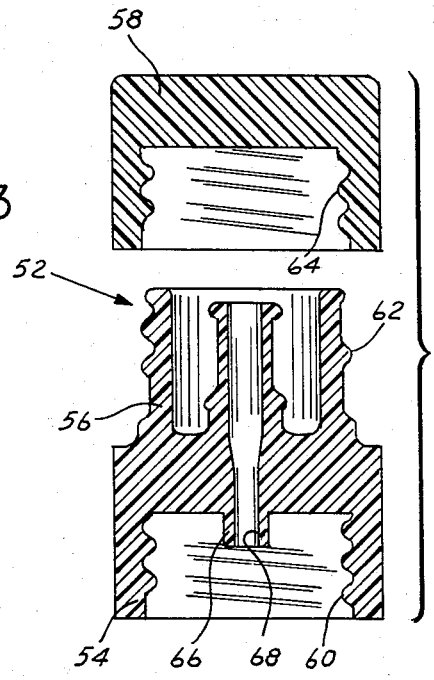
FIG. 5 is a longitudinal section of another embodiment of the coupling member.

Another embodiment of the coupling member 12 of the present invention is shown in FIG. 5. This embodiment has particular utility in assuring that a child does not gain access to the liquid medication of container 10. Specifically, coupling device 52 is provided for interconnecting the container 10 and the syringe 14. Coupling device 52 includes a first coupling cap 54, a threaded housing 56, and a second coupling cap 58. The first coupling cap 54 is adapted to surround and be fastened to the neck 16 of container 10 by means of child-proof locking means including threads 60 positioned along the inner wall of the first coupling cap 54 so that the possibility of a child removing the first coupling cap 54 from the container 10 is minimized. The housing 56 is connected to the first coupling cap 54 and extends vertically therefrom. The outer wall of the housing 56 includes threads 62. When no liquid is being transferred from the container 10 to the syringe 14, the second coupling cap 58 is fastened to and surrounds housing 56 along threads 62. The second coupling cap 58 also has child-proof locking means including threads 64 to minimize the possibility of removal thereof from the housing 56 by a child.

An opening is formed in the top surface of the first coupling cap 54 and a tubular coupler 66 having a bore 68 is held therein and extends into the housing 56. When discharging liquid from the container 10 into the syringe barrel 20, the second coupling cap 58 is removed and the inner tip 30 of the syringe 14 is inserted into the bore 68 of the coupler 66. Just as described previously, the syringe 14 can now receive the liquid medication.

In yet another embodiment of the present invention, as illustrated in FIGS. 6–11, a system is provided for the dispensation of liquid medication into the mouth of a patient. As shown in FIG. 8, the system includes a container 70, a coupling assembly 72 and a syringe 74.

In FIG. 6, the container 70 and coupling assembly 72 are shown when the system is in a nonoperational state. The container 70, which houses the liquid medication, includes a cylindrical neck 76 having a threaded outer wall 78. The coupling assembly 72 includes a coupler body 80 having a top wall 82 and an inner side wall 84. The inner side wall 84 includes threads 86 for fixedly fastening the coupling assembly 72 to the outer wall 78 of the neck 76 of the container 70. It should be understood that a coupling assembly comprising two coupler bodies, that are adapted to create child-proof locking means, could be employed in this embodiment to achieve the same advantages set forth herein.

The coupling assembly 72 also includes a vertical head member 88 which passes perpendicularly through the top wall 82 of the coupler body 80, and which is substantially positioned about the common longitudinal axis of the coupling assembly 72 and container 70, see FIG. 6. The head member 88 has a longitudinal and substantially circular bore 90, which houses a resilient and substantially cylindrical valve member 92. The bore 90 and valve member 92 are designed so that, when the system is in a nonoperational state, an edge portion 94 on the periphery of the valve member 92 abuts against an inner lip 96 formed into the inside wall of the head member 88, to create a leak-proof valve. A plurality of ribs 98 project radially inward from the inside wall of the head member 88, see FIG. 7. These ribs 98 extend longitudinally from the inner lip 96 of the head member 88 down to the bottom end 100 of the head member 88. The ribs 98 define narrow longitudinal passageways 102 that also run from the inner lip 96 of the head member 88 to the bottom end 100 of the head member 88, see FIG. 6. To maintain the aforementioned valve, the bottom end 104 of the resilient valve member 92 is kept in a fixed position, relative to the head member 88. This is achieved by the inclusion of at least two restraining ribs 106 that extend radially outward from the bottom end 104 of the valve member 92, and by crimping the bottom end 100 of the head member 88. The top end of the valve member 92 includes a bisecting groove which defines a lateral passageway 107.

The head member and valve member combination described herein can be obtained from Roberts Company of Florida.

Figure 9:
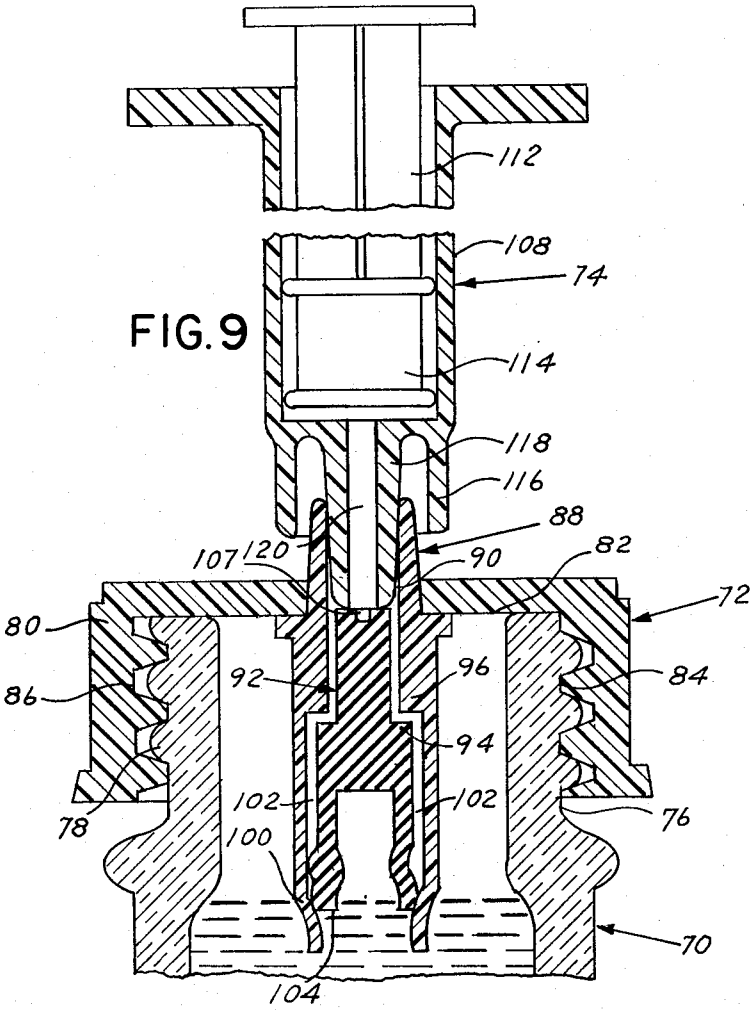
FIG. 9 is a longitudinal section of the embodiment of FIG. 6 showing the syringe barrel connected to the head member of the coupling assembly before dispensation of the liquid medication.

In FIG. 8 and FIG. 9, a syringe 74 is shown connected to the head member 88 of the coupling assembly 72, which is fixedly fastened to the container 70. The syringe 74 is adapted to receive the liquid medication from the container 70. The syringe 74 is included in the system to insure that a predetermined amount of the medication housed in the container 70 can be withdrawn and administered to the patient. Like syringe 14, the syringe 74 includes a cylindrical barrel 108 with marking lines 110 thereon to indicate the amount of liquid transferred from the container 70 to the syringe 74. As shown in FIG. 10, the syringe 74 further includes a plunger 112 for sliding movement within the barrel 108. A rubber stopper or plunger head 114 is connected to an end of the plunger 112 and creates a leakproof interface with the inside of the barrel 108 of the syringe 74. A hollow outer tip 116 is integral with an end of the syringe barrel 108 and concentrically surrounds a portion of a slightly tapered inner tip 118, that is integral with the same end of the syringe barrel 108, and which extends longitudinally beyond the outer tip 116, see FIG. 9. The inner tip 118 includes a bore 120 which communicates with the inside of the barrel 108 of the syringe 74. To connect the syringe 74 with the coupling assembly 72, the inner tip 118 is inserted into the head member bore 90 at the top of the head member 88, see FIG. 9. In this manner, a leakproof connecting interface between the adjacent surfaces of the inner tip 118 and inside wall of the head member 88 is created.

In operation of this embodiment of the present invention, the syringe 74 is connected to the coupling assembly 72 as described above, and as depicted in FIGS. 8 and 9. When that connection is made, the inner tip 118 contacts the top of the valve member 92, and forces the edge portion 94 on the periphery of the valve member 92 downwardly away from the inner lip 96 of the head member 88, see FIG. 9. By so doing, the aforementioned valve is opened. As represented in FIG. 9, the bottom end 100 of the resilient head member 88 is compressed when the syringe 74 and coupling assembly 72 are connected. Initially, the rubber stopper 114 within the syringe 74 is positioned adjacent to the outer and inner tips 116, 118 of the syringe 74 at the bottom end of the barrel 108.

Figure 11:
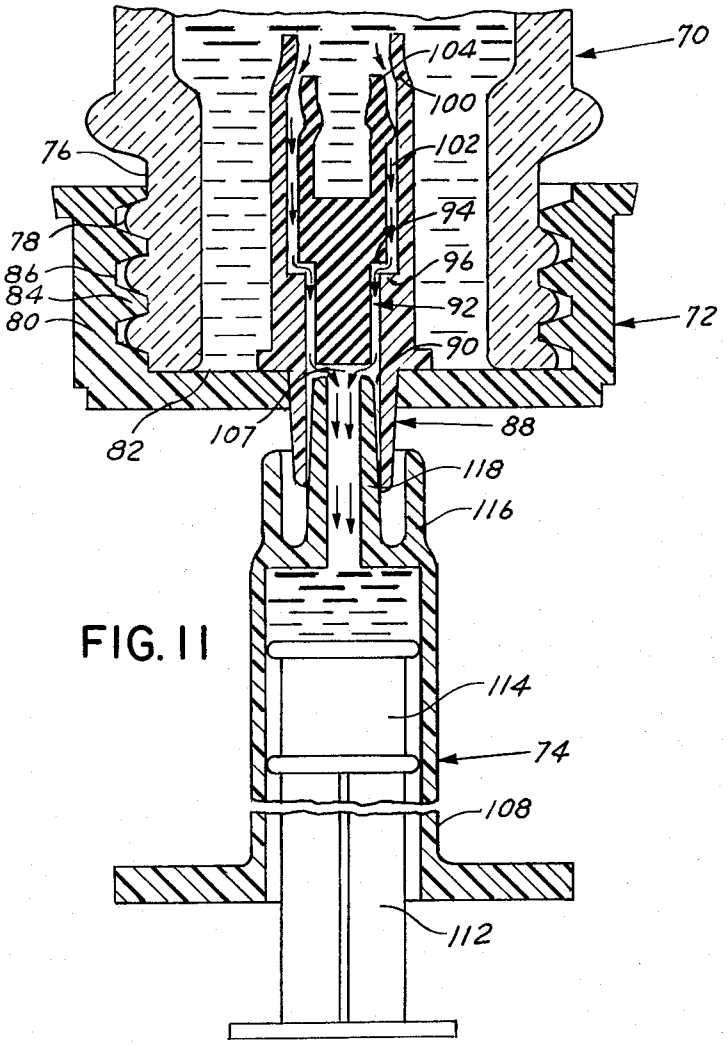
FIG. 11 is a longitudinal section of the embodiment of FIG. 6, that is inverted and turned 90° from the view shown in FIG. 9, so as to show the liquid being drawn from the container, through the head member of the coupling assembly, and into the syringe barrel.

After the syringe 74 and coupling assembly 72 have been connected, the container 70/coupling assembly 72/syringe 74 combination is inverted, as shown in FIGS. 10 and 11. The plunger 112 is then pulled vertically downward through the barrel 108. The movement of the plunger 112, the rubber stopper 114 connected thereto, creates a large enough vacuum within the barrel 108 to draw the liquid medication through the longitudinal passageways 102 of the head member 88, through the aforementioned valve, through the lateral passageway 107 located on the top of the valve member 92, through the bore of the inner tip 118, and into the barrel 108, see FIG. 11. The rubber stopper 114 is continuously moved to a predetermined position in the barrel 108 so that a predetermined amount of liquid is drawn into the barrel 108. After the desired amount of liquid is transferred into the barrel 108, the syringe 74 is removed from the head member 88 of the coupling assembly 72. The predetermined liquid contents of the syringe 74 are then administered to the patient by dispensing the liquid into the mouth of the patient.

It should be appreciated that the inclusion of the valve embodiment of the present invention, eliminates the need for any type of cover or cap on top of the head member 88 to prevent escape of the liquid medication from the container 70 during non-operation of the system. As such, this embodiment is faster and simpler to use. In addition, the valve member 92 and restrictive longitudinal and lateral passageways 102, 107 included in this embodiment of the present invention, substantially minimize the likelihood of any liquid escaping from the system upon disconnection of the syringe 74 from the head member 88 of the coupling assembly 72.

Based on the foregoing description, it is readily seen that a simple, yet highly efficient, apparatus is provided for use in orally administering liquid medication to a patient. The apparatus includes a coupler which is easily attached to a bulk container which houses the medication. A syringe is attached to the coupler for receiving a predetermined amount of liquid medication. A significant degree of accuracy with respect to the amount of medication orally taken by a patient is achieved because of the use of the syringe while large amounts of medication can be stored in a bulk container. While the liquid medication is stored in the container, the syringe-receiving bore can be sealed off to minimize contamination of the liquid contents of the container.

Although the present invention has been described with reference to a plurality of embodiments thereof, it is readily understood that variations and modifications can be effected within the spirit and scope of this invention.

What is claimed is:

1. A method for providing orally to a patient a predetermined amount of liquid medication, comprising the steps of:

providing a container having a neck with a threaded outer wall, said container housing liquid medication to be received into the mouth of the patient;

providing an integral one-piece coupling member having a bore inner surace defining a bore, said coupling member including a skirt having an inner wall comprising threads;

using said threads of said inner wall of said coupling member to sealingly engage said coupling member to said outer wall of said container;

providing a syringe including a barrel and a plunger, said barrel having a tip extending from an end of said barrel;

joining said coupling member with said syringe barrel tip by inserting said tip of said syringe barrel into said bore;

maintaining said skirt and said bore inner surface in their same positions relative to each other;

moving said plunger to cause said liquid medication to be received into said tip and then into said syringe barrel;

obtaining a predetermined amount of said liquid medication in said syringe barrel;

discontinuing the obtaining of said liquid medication from said container; and transferring said predetermined amount of liquid medication into the mouth of the patient.

2. A coupling device for coupling a container holding liquid medication to be received orally by a patient, said container including a neck having a threaded outer wall and an opening formed through said neck with a syringe including a barrel and a plunger, said plunger slidably disposed within said barrel, said barrel including a tip, said tip having an outer peripheral surface, a predetermined amount of said liquid medication being transferred from said container to said syringe and said liquid medication being received in the mouth of a patient, said device comprising:

a skirt having an inner side wall comprising threads, said threaded inner side wall fixedly and sealingly engaging said threaded outer wall of said neck;

a top surface integrally joined to said skirt and having a bore with an inner bore surface arranged to sealingly receive said outer peripheral surface of said syringe tip, said skirt, said top surface, and said bore inner surface being an integral, one-piece member wherein no relative movement occurs between said inner bore surface and said skirt; and a cap member, connected to said skirt or said top surface, said cap member having means for sealing said bore to prevent the escape of said liquid medication therefrom.

3. A method for orally providing a patient with a desired amount of liquid medication, comprising the steps of:

providing a container having a neck with a threaded outer wall, said container housing liquid medication to be taken orally by the patient;

providing an integral one-piece coupling device having a bore, said coupling device including a skirt having an inner wall comprising threads;

matingly engaging said skirt and said neck using said threads of said inner wall and said threaded outer wall;

providing a valve member in said bore, said valve member being resiliently movable in a longitudinal direction between a first position wherein said valve member is in an open state and a second position wherein said valve member is in a closed state;

providing a syringe including a barrel and a plunger, said barrel having a tip extending from an end of said barrel;

inserting said tip of said syringe barrel into said bore;

contacting said valve member using said syringe barrel tip;

causing said valve member to move to its first position by moving said valve member in the longitudinal direction;

moving said plunger relative to said syringe barrel to cause said liquid medication to be received into said tip and then into said syringe barrel;

obtaining a desired amount of said liquid medication in said syringe barrel;

discontinuing the obtaining of said liquid medication into said syringe barrel; and transferring said desired amount of liquid medication into the mouth of the patient.

4. A combination liquid containing, coupling, and dispensing apparatus for providing a predetermined amount of liquid medication for dispensing orally to a patient, comprising:

a container for holding liquid medication, said container including a neck having a threaded outer wall and an opening formed through said neck;

a coupling member having a threaded inner side wall and a top wall, said threaded inner side wall matingly surrounding said threaded outer wall of said neck to provide sealing engagement therebetween;

a head member, provided at said top wall of said coupling member and having a bore therethrough, said head member having a first portion and a second portion with said first portion having an inner lip protruding inwardly into said bore;

a resiliently movable valve member positioned within said bore of said first portion of said head member for sealing engagement with said inner lip of said first portion of said head member; and a syringe including a barrel and a plunger, said plunger slidably disposed within said barrel, said barrel including a tip member extending from a first end thereof, said tip member being inserted into said bore of said second portion of said head member and sealingly engaging said second portion of said head member wherein said tip member contacts and moves said valve member in a longitudinal direction to cause disengagement of said valve member from said inner lip of said first portion of said head member.

5. A combination, as claimed in claim 4, further including:

locking means operatively associated with said coupling member to restrict access to the liquid medication.

* * * * *